US010029887B2

(12) United States Patent
Ding et al.

(10) Patent No.: US 10,029,887 B2
(45) Date of Patent: Jul. 24, 2018

(54) ELECTROLESS METAL COATING OF LOAD BEARING MEMBER FOR ELEVATOR SYSTEM

(71) Applicant: Otis Elevator Company, Farmington, CT (US)

(72) Inventors: Zhongfen Ding, South Windsor, CT (US); Paul Papas, West Hartford, CT (US); Brad Guilani, Woodstock Valley, CT (US); Georgios S. Zafiris, Glastonbury, CT (US); Daniel A. Mosher, Glastonbury, CT (US); Scott Alan Eastman, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/083,663

(22) Filed: Mar. 29, 2016

(65) Prior Publication Data

US 2017/0283220 A1 Oct. 5, 2017

(51) Int. Cl.
*B66B 7/06* (2006.01)
*C23C 18/16* (2006.01)
(Continued)

(52) U.S. Cl.
CPC ..... *B66B 7/062* (2013.01); *C23C 18/1605* (2013.01); *C23C 18/31* (2013.01); *D07B 1/22* (2013.01); *D07B 2501/2007* (2013.01)

(58) Field of Classification Search
CPC ..... F16G 9/02; F16G 5/14; F16G 1/16; F16G 1/22; D07B 1/22; D07B 2201/2087;
(Continued)

(56) References Cited

U.S. PATENT DOCUMENTS 4,225,649 A * 9/1980 Peterson ..... C09D 5/18 174/110 AR
4,278,739 A * 7/1981 Coll-Palagos ..... C23C 18/2066 205/161
(Continued)

FOREIGN PATENT DOCUMENTS

DE 102009006063 A1 7/2010
EP 1153167 B1 * 5/2006 ..... B66B 7/06
(Continued)

OTHER PUBLICATIONS

Kenichiroh Mukai, Kwonil Kim, Brian Eastep, Lee Gaherty and Anirudh Kashyap, "Adhesive Enhancement Technology for Directly Metal Plating on EMC"; 8 pages.
(Continued)

*Primary Examiner* — Michael A Riegelman
(74) *Attorney, Agent, or Firm* — Cantor Colburn LLP

(57) ABSTRACT

A belt for an elevator system includes a plurality of tension members arranged along a belt width, a jacket material at least partially encapsulating the plurality of tension members defining a traction surface, a back surface opposite the traction surface together with the traction surface defining a belt thickness, and two end surfaces extending between the traction surface and the back surface defining the belt width. A metallic coating layer applied from a liquid solution is positioned over at least one end surface of the two end surfaces.

14 Claims, 6 Drawing Sheets

(51) Int. Cl.
*C23C 18/31* (2006.01)
*D07B 1/22* (2006.01)

(58) Field of Classification Search
CPC .... D07B 2401/2035; D07B 2501/2007; D07B 2801/22; D07B 2205/2003; D07B 2205/2064; B32B 3/10; B32B 5/147; B32B 2255/10; B32B 2255/025; B66B 7/062
See application file for complete search history.

(56) References Cited

U.S. PATENT DOCUMENTS 4,705,161 A 11/1987 Gozdiff
5,104,735 A * 4/1992 Cioffi ..... C08K 3/34 174/110 AR
5,119,927 A 6/1992 Bruggemann
5,153,023 A 10/1992 Orlowski et al.
5,462,773 A 10/1995 Swift et al.
5,648,125 A 7/1997 Cane
6,337,442 B1 * 1/2002 Lienert ..... C09D 179/08 174/120 R
6,794,027 B1 * 9/2004 Araki ..... C09D 127/18 427/385.5
7,168,231 B1 1/2007 Chou et al.
7,364,799 B2 * 4/2008 Kurita ..... B32B 15/08 428/474.4
8,389,126 B2 3/2013 Kusinski et al.
8,402,731 B2 * 3/2013 Naito ..... B66B 7/06 57/210
8,479,887 B2 * 7/2013 Yu ..... B66B 7/062 187/250
8,492,471 B2 * 7/2013 Albright ..... C04B 26/02 524/431
8,852,734 B2 * 10/2014 Tanaka ..... C08G 59/4014 428/297.4
9,051,651 B2 6/2015 Veronesi et al.
2008/0289912 A1 11/2008 Perron
2010/0009206 A1 * 1/2010 Ataka ..... C08G 73/1007 428/458
2010/0031623 A1 * 2/2010 Vanderbeken ..... D07B 1/0613 57/213
2010/0133046 A1 6/2010 Allwardt et al.
2011/0220387 A1 * 9/2011 Szylakowski ..... H01B 7/295 174/113 C
2012/0329591 A1 12/2012 Goeser et al.
2013/0171463 A1 7/2013 Chang et al.
2014/0027211 A1 1/2014 Wesson et al.
2014/0076669 A1 3/2014 Wesson et al.
2015/0034359 A1 * 2/2015 Sugita ..... H01B 7/295 174/107
2015/0079331 A1 3/2015 Hung et al.
2015/0191331 A1 7/2015 Orelup et al.
2015/0259176 A1 9/2015 Goeser et al.
2015/0336335 A1 * 11/2015 Okawa ..... B29C 43/12 187/401

FOREIGN PATENT DOCUMENTS

EP 2913288 A1 9/2015
JP 2000222949 A * 8/2000
JP 2002231070 A * 8/2002 ..... D07B 1/22
NL 1009742 C1 6/1999
WO WO 2014014456 A1 * 1/2014 ..... D07B 1/162

OTHER PUBLICATIONS

Netherlands Patent No. 1009742; Date of Publication: Jun. 8, 1999; Abstract Only, 1 page.
International Search Report and Written Opinion; International Application No. PCT/US2017/024715; International Filing Date: Mar. 29, 2017; dated Aug. 1, 2017; 13 pages.

* cited by examiner

ELECTROLESS METAL COATING OF LOAD BEARING MEMBER FOR ELEVATOR SYSTEM

BACKGROUND

Embodiments disclosed herein relate to elevator systems, and more particularly, to coating of a load bearing member for use in an elevator system.

Elevator systems are useful for carrying passengers, cargo, or both, between various levels in a building. Some elevators are traction based and utilize load bearing members such as ropes or belts for supporting the elevator car and achieving the desired movement and positioning of the elevator car.

Where ropes are used as load bearing members, each individual rope is not only a traction device for transmitting the pulling forces but also participates directly in the transmission of the traction forces. Where belts are used as a load bearing member, a plurality of tension elements are embedded in a common elastomer belt body. The tension elements are exclusively responsible for transmitting the pulling forces, while the elastomer material transmits the traction forces. In some belts, the tension members are cords formed from a plurality of elements such as steel wires, while in other belts the tension members may be formed from unidirectional fibers arranged in a rigid matrix composite, providing significant benefits when used in elevator systems, particularly high rise systems. Fire retardation standards are some of the key safety requirements that each belt is required to meet.

BRIEF SUMMARY

In one embodiment, a belt for an elevator system includes a plurality of tension members arranged along a belt width, a jacket material at least partially encapsulating the plurality of tension members defining a traction surface, a back surface opposite the traction surface together with the traction surface defining a belt thickness, and two end surfaces extending between the traction surface and the back surface defining the belt width. A metallic coating layer applied from a liquid solution is positioned over at least one end surface of the two end surfaces.

Additionally or alternatively, in this or other embodiments the metallic coating layer is located at the at least one end surface and a selected portion of the traction surface and/or the back surface.

Additionally or alternatively, in this or other embodiments the metallic coating layer includes nickel, copper, aluminum, chrome, zinc, tin, gold, silver or alloys thereof, or alloys of nickel and phosphorus, or nickel and polytetrafluoroethylene (PTFE), or nickel and boron or alloys or combinations thereof.

Additionally or alternatively, in this or other embodiments the metallic coating layer is discontinuous along a length of the belt.

Additionally or alternatively, in this or other embodiments the metallic coating layer is configured to improve flame retardation properties of the belt.

Additionally or alternatively, in this or other embodiments the jacket material is an elastomeric material.

Additionally or alternatively, in this or other embodiments the metallic coating layer is applied via an electroless plating process.

In another embodiment, a method for forming a belt for an elevator system includes forming one or more tension elements and at least partially enclosing the one or more tension elements in a jacket material, the jacket material defining a traction surface, a back surface opposite the traction surface together with the traction surface defining a belt thickness, and two end surfaces extending between the traction surface and the back surface defining the belt width. A metallic coating layer is applied to at least one end surface of the two end surfaces from a liquid solution to improve fire retardation properties of the belt.

Additionally or alternatively, in this or other embodiments the metallic coating layer is applied to the at least one end surface and a selected portion of the traction surface and/or the back surface.

Additionally or alternatively, in this or other embodiments the metallic coating includes one or more of nickel, copper, aluminum, chrome, zinc, tin, gold, silver or alloys thereof, or alloys of nickel and phosphorus, or nickel and polytetrafluoroethylene (PTFE), or nickel and boron or alloys or combinations thereof.

Additionally or alternatively, in this or other embodiments applying the metallic coating layer further includes activating the at least one end surface to improve adhesion of the metallic coating layer to the at least one end surface, submerging the at least one end surface in an electrolyte solution for a selected period of time, the electrolyte solution containing a selected metal material, and removing the at least one end surface from the electrolyte solution, the metal material deposited at the at least one end surface to form the metallic coating layer.

Additionally or alternatively, in this or other embodiments activating the at least one end surface includes one or more of cleaning with an oxidant, depositing a seed metal layer including tin, platinum or palladium, surface cleaning with an organic oxidizer solution or a strong acid solution, plasma treatment, ozone treatment, corona treatment, or UV laser treatment of the jacket material.

Additionally or alternatively, in this or other embodiments the metallic coating layer is applied discontinuously along a length of the belt.

Additionally or alternatively, in this or other embodiments selected portions of the at least one end surface are masked to prevent adhesion of the metallic coating layer at the selected portions resulting in the discontinuous metallic coating layer.

Additionally or alternatively, in this or other embodiments the metallic coating is applied via an electroless plating process.

Additionally or alternatively, in this or other embodiments the metallic coating layer is applied to a first end surface of the two end surfaces, the belt is turned 180 degrees, and the metallic coating layer is applied to a second end surface of the two end surfaces.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

The detailed description explains disclosed embodiments, together with advantages and features, by way of example with reference to the drawings.

DETAILED DESCRIPTION

Figure 1:
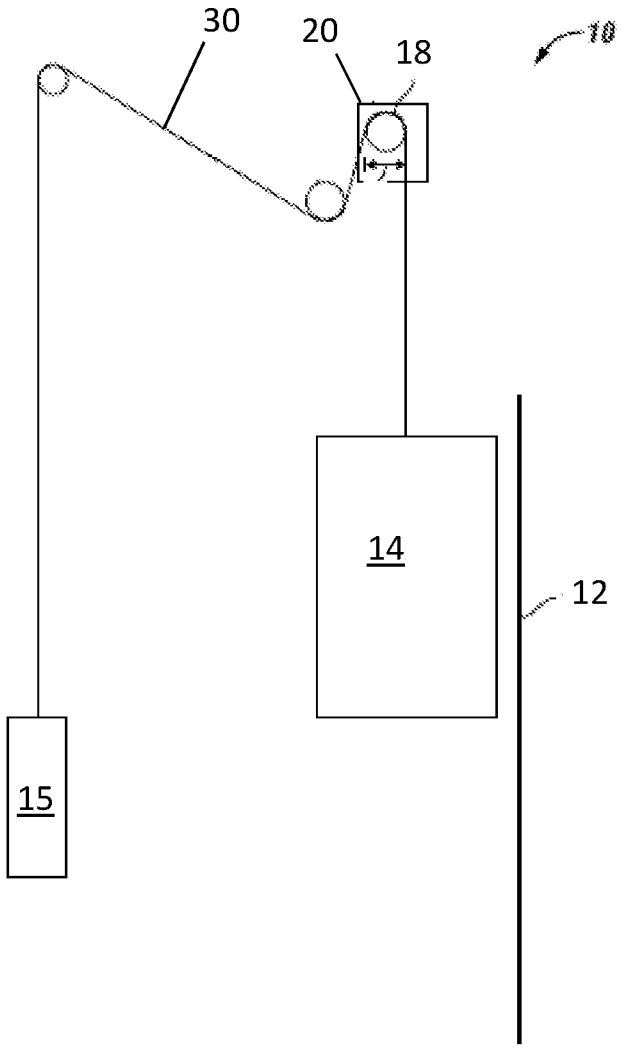
FIG. 1 is a perspective view of an example of a traction elevator system.

Referring now to FIG. 1, an exemplary embodiment of an elevator system 10 is illustrated. The elevator system 10 includes an elevator car 14 configured to move vertically upwardly and downwardly within a hoistway 12 along a plurality of car guide rails (not shown). Guide assemblies mounted to the top and bottom of the elevator car 14 are configured to engage the car guide rails to maintain proper alignment of the elevator car 14 as it moves within the hoistway 12.

The elevator system 10 also includes a counterweight 15 configured to move vertically upwardly and downwardly within the hoistway 12. The counterweight 15 moves in a direction generally opposite the movement of the elevator car 14 as is known in conventional elevator systems. Movement of the counterweight 15 is guided by counterweight guide rails (not shown) mounted within the hoistway 12. In the illustrated, non-limiting embodiment, at least one load bearing member 30, for example, a belt, coupled to both the elevator car 14 and the counterweight 15 cooperates with a traction sheave 18 mounted to a drive machine 20. To cooperate with the traction sheave 18, at least one load bearing member 30 bends in a first direction about the traction sheave 18. In one embodiment, any additional bends formed in the at least one load bearing member 30 must also be in the same first direction. Although the elevator system 10 illustrated and described herein has a 1:1 roping configuration, elevator systems 10 having other roping configurations and hoistway layouts are within the scope of the present disclosure.

Figure 2:
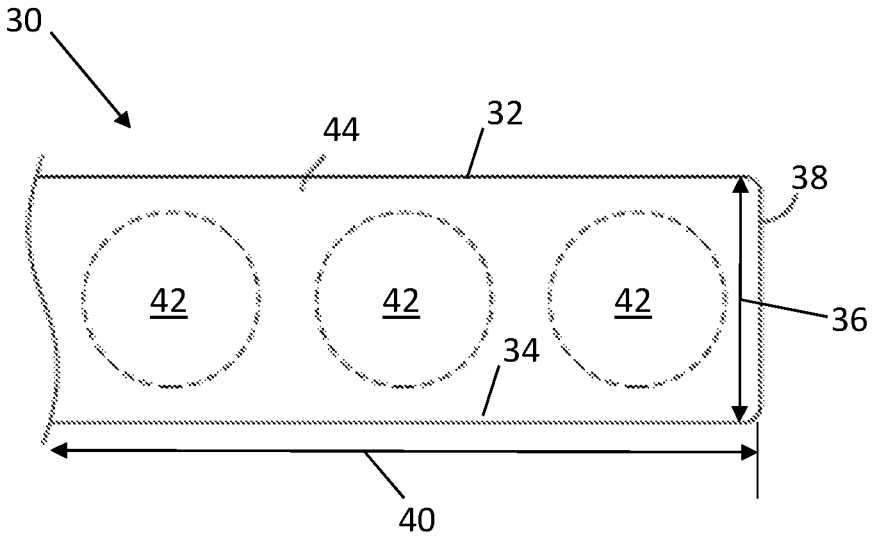
FIG. 2 is a cross-sectional view of an exemplary embodiment of a belt for an elevator system.

Referring now to FIG. 2, a partial cross-sectional view of an exemplary load bearing member or belt 30 is illustrated. The belt 30 includes a traction surface 32 interactive with the traction sheave 18, and a back surface 34 opposite the traction surface 32 and defining a belt thickness 36 therebetween. The belt 30 further includes two end surfaces 38 (one shown in the partial cross-section of FIG. 2) extending between the traction surface 32 and the back surface 34 and defining a belt width 40 therebetween. In some embodiments, the belt 30 has an aspect ratio of belt width 40 to belt thickness 36 that is greater than one.

The belt 30 includes plurality of tension members 42 extending along the belt 30 length and arranged across the belt width 40. In some embodiments, the tension members 42 are equally spaced across the belt width 40. The tension members 42 are at least partially enclosed in a jacket material 44 to restrain movement of the tension members 42 in the belt 30 and to protect the tension members 42. The jacket material 44 defines the traction surface 32 configured to contact a corresponding surface of the traction sheave 18. Exemplary materials for the jacket material 44 include the elastomers of thermoplastic and thermosetting polyurethanes, polyamide, thermoplastic polyester elastomers, and rubber, for example. Other materials may be used to form the jacket material 44 if they are adequate to meet the required functions of the belt 30. For example, a primary function of the jacket material 44 is to provide a sufficient coefficient of friction between the belt 30 and the traction sheave 18 to produce a desired amount of traction therebetween. The jacket material 44 should also transmit the traction loads to the tension members 42. In addition, the jacket material 44 should be wear resistant and protect the tension members 42 from impact damage, exposure to environmental factors, such as chemicals, for example.

Figure 3:
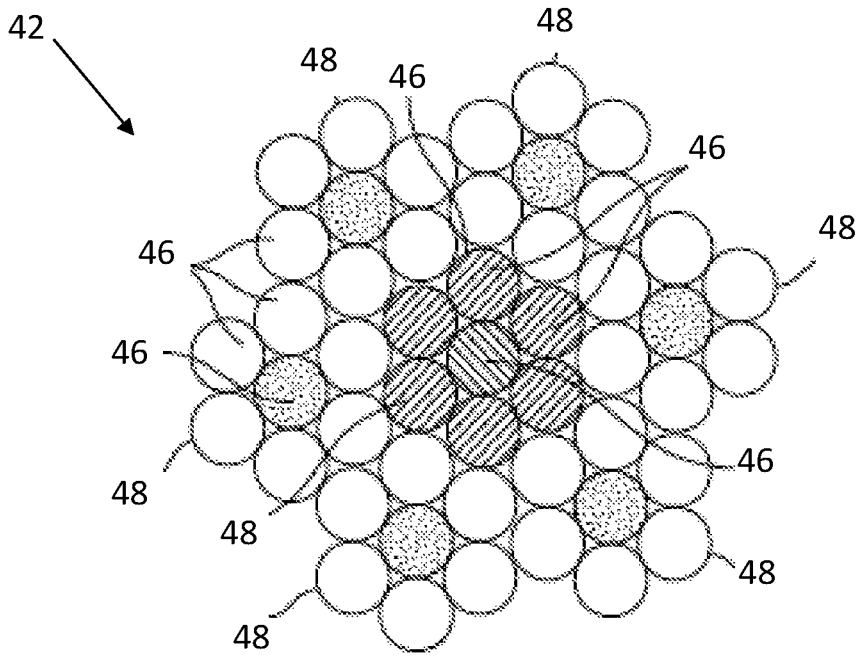
FIG. 3 is a cross-sectional view of an exemplary embodiment of a tension member for a belt.

In some embodiments, as shown in FIGS. 2 and 3, each tension member 42 is formed from a plurality of metallic, for example steel, wires 46, arranged into a plurality of strands 48, which are in turn arranged into a cord, or tension member 42. In other embodiments, the tension members 42 may be formed from other materials and may have other configurations. For example, in some embodiments, the tension member 42 may be formed from a plurality of fibers arranged in a rigid matrix composite. While in the embodiment shown there are six tension members 42 in the belt 30, the number of tension members 42 is merely exemplary. In other embodiments, for example, one, two, three, four, five, seven or more tension members 42 may be utilized. It is to be appreciated that arrangement of wires 46 shown in FIG. 3 is merely exemplary, and that other arrangements of wires 46 to form tension members 42 are contemplated within the scope of the present disclosure.

Figure 4:
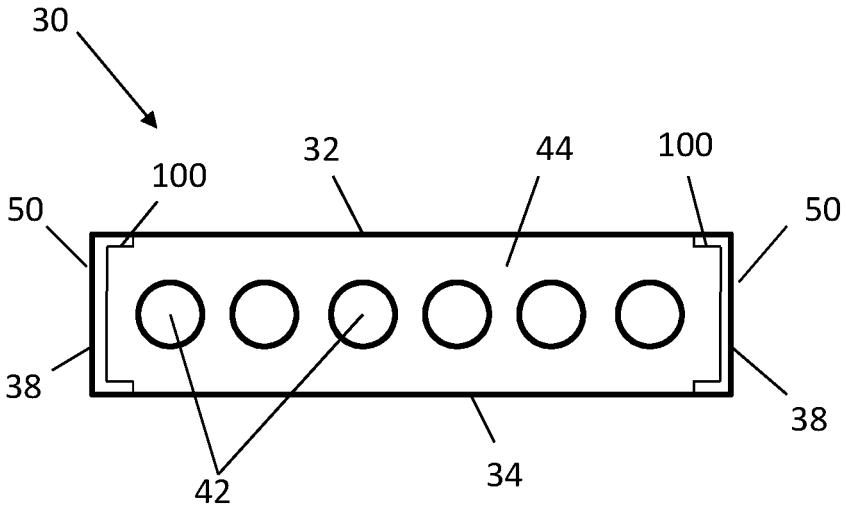
FIG. 4 is a perspective view of an exemplary embodiment of a belt for an elevator system.

Referring now to FIG. 4, fire safety performance of the belt 30 is improved with a metallic coating layer 50 over the jacket material 44 at the end surfaces 38, and in some embodiments wrapping partially around the belt 30 to extend onto the traction surface 32 and/or the back surface 34. The metallic coating layer 50 is particularly effective in preventing flame propagation around the belt 30 from the traction surface 32 to the back surface 34 or vice versa, via the end surfaces 38. In some embodiments, the metallic coating layer 50 may extend to cover up to about 40% of the width of the traction surface 32 and/or the back surface 34. In other embodiments, the metallic coating layer 50 may extend to cover between 10% and 20% of the width of the traction surface 32 and/or the back surface 34. In one embodiment, the metallic coating layer 50 may wrap around belt 30 to extend 0.1"-0.4" (2.5-10.2 millimeters) onto the traction surface 32 and/or the back surface 34.

The traction surface 32 and/or the back surface 34 may be shaped prior to application of the metallic coating layer 50 to form step bands 100 over which the metallic coating layer 50 is applied. A depth and width of the step band 100 are set to match the width and thickness of the metallic coating layer 50 to be applied thereat.

Figure 5:
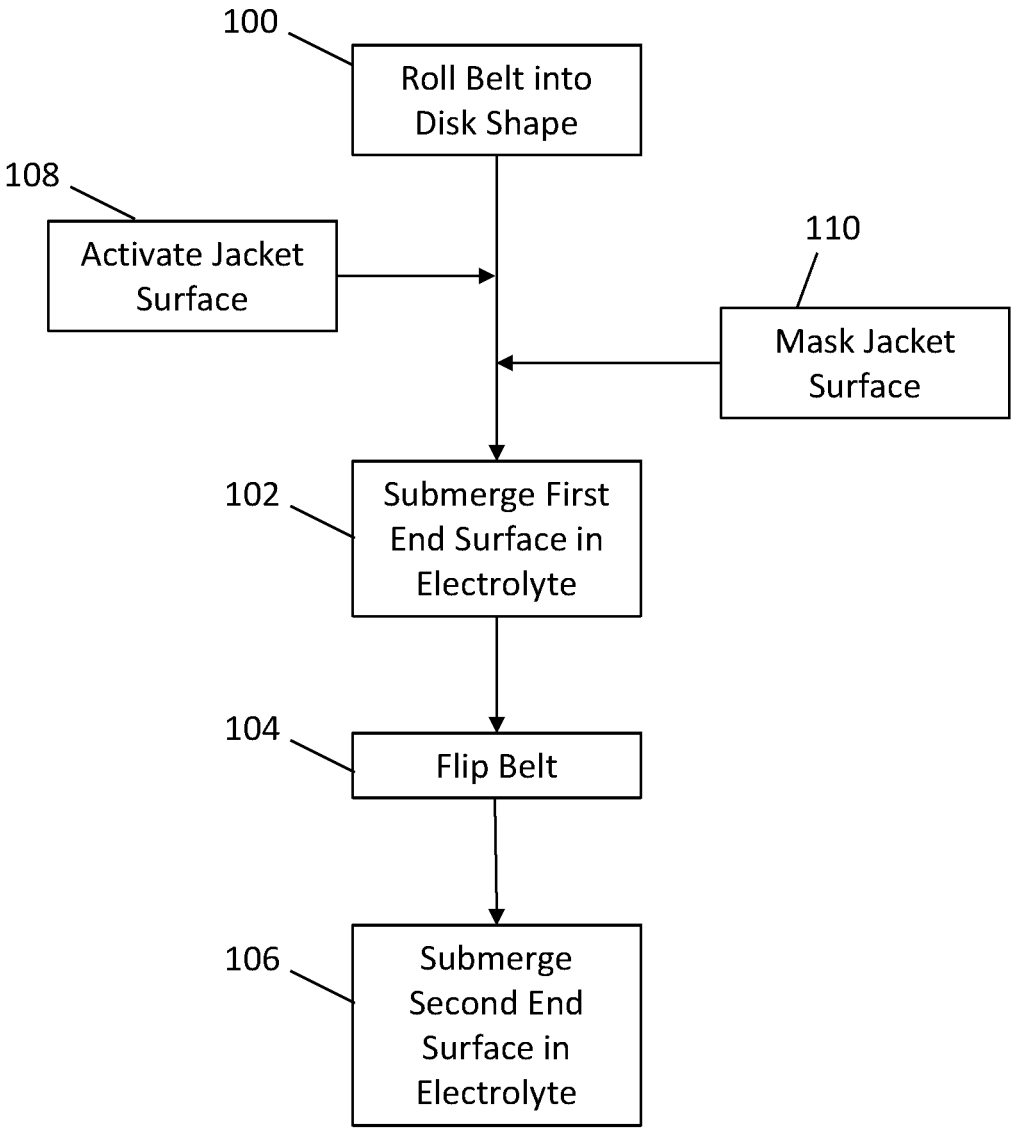
FIG. 5 is a flow chart of an embodiment of a coating process for a belt.

The metallic coating layer 50 is applied to the belt 30 via an electroless plating operation, one embodiment of which is illustrated in FIG. 5. In the embodiment of FIG. 5, the electroless plating process is performed on an already-completed belt 30, which may be rolled into a disk shape, with end surfaces 38 exposed. The electroless plating process includes submerging a selected portion of the belt 30, such as the end surfaces 38 and selected portions of the traction surface 32 and/or the back surface 34, in an electrolyte solution including a metal material, for example, nickel, copper, tin, gold, aluminum, chrome, zinc, silver or alloys thereof, or alloys of nickel and phosphorus, or nickel and polytetrafluoroethylene (PTFE) and nickel and boron. The electroless plating operation is carried out at a temperature less than 90 degrees Celsius, preferably less than 80 degrees Celsius or even at room temperature to prevent degradation or melting of the elastomer jacket material 44 during the electroless plating process. A variety of coating compositions and related mechanical properties can be produced using electroless plating process. As an example, electroless nickel coating may additionally contain boron or phosphorus, where the different levels of phosphorus determine the mechanical properties of the coating. Typically, electroless plated nickel with low levels of phosphorus (2-5% wt) has higher as deposited hardness than medium (6-9% wt) and high phosphorus (10-13% wt) ones. Nickel-PTFE and nickel-boron electroless plated coatings provide lubricity and wear properties. The coating's mechanical and frictional properties can thus be tuned to achieve the desired level of durability and traction against the traction sheave 18. The metallic coating layer 50 may also be applied through electroplating after the electroless plating process on belt 30. It is to be appreciated that electroless plating on belt 30 allows it to be subsequently electroplated with many different metals with controllable thickness.

The belt 30 is initially rolled into a disk shape at step 100, then a first end surface 38 is submerged in the electrolyte solution for a selected length of time at step 102. In some embodiments, the length of time may be about 10 minutes, but may vary depending on the desired metallic coating layer 50 thickness and/or the metal to be deposited on the end surface 38. The belt 30 is then removed from the electrolyte solution and flipped 180 degrees at step 104 and a second end surface 38 is submerged in the electrolyte solution at step 106 to deposit the metallic coating layer 50 at the second end surface 38.

In some embodiments, before applying the electrolyte solution to the belt 30, the jacket material 44 of the belt 30 is activated to promote attraction of the metal material in the electrolyte solution to the belt 30 and adhesion of the metal material to the belt 30 at step 108. For example, the jacket material 44 surface may be cleaned with oxidants such as a potassium permanganate ($KMnO_4$) solution, hydrogen peroxide solution, or ammonium persulfate solution to generate surface functional groups at the jacket material 44 surface. Other surface activation methods may include depositing a tin (Sn) seed layer using a tin chloride ($SnCl_2$) solution, deposition of other seed metals such as platinum (Pt) or palladium (Pd), surface cleaning with an organic oxidizer solution or a strong acid solution, plasma treatment, ozone treatment, corona treatment, UV laser activation of the jacket material 44, or any combination of these methods. The activation may further be via a secondary process where a second jacket material fixed around jacket material 44, with second jacket material containing an activator material.

Figure 6:
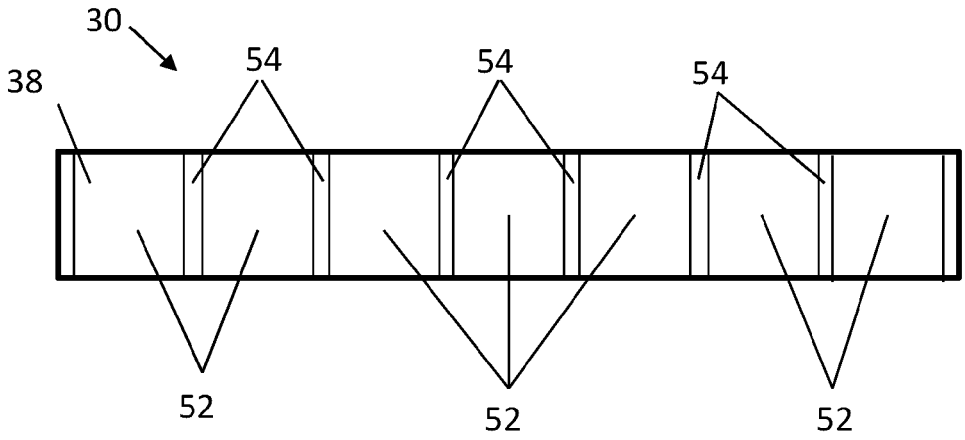
FIG. 6 is an illustration of an embodiment of a belt with a discontinuous metal coating layer.

Due to repeated bending and in some instances stretching of the belt 30 during operation of the elevator system 10, the metallic coating layer 50 may be applied discontinuously along the edge of the belt 30. To achieve this, in some embodiments, the jacket material 44 is masked to prevent adhesion of the metal material to selected portions of the jacket material 44, at step 110 in FIG. 5. One example of a discontinuous metallic coating layer 50 is shown in FIG. 6 in which the metallic coating layer 50 has coating blocks 52 separated by coating gaps 54 at intervals along the length of the belt 30. The block and gap pattern is created by masking the portions of the jacket material 44 where gaps 54 are desired. Thus the metallic coating layer 50 only adheres at the unmasked portion of the jacket material 44. Alternatively, the cleaning or activation process may be performed at the portions of the jacket material 44 where the metallic coating layer 50 is desired, such that the metallic coating layer 50 will adhere to the jacket material only at those portions subjected to the cleaning or activation process. It is to be appreciated that the pattern shown in FIG. 6 is merely exemplary, and other patterns of selective application of the metallic coating layer 50 are contemplated within the scope of the present disclosure.

Figure 7:
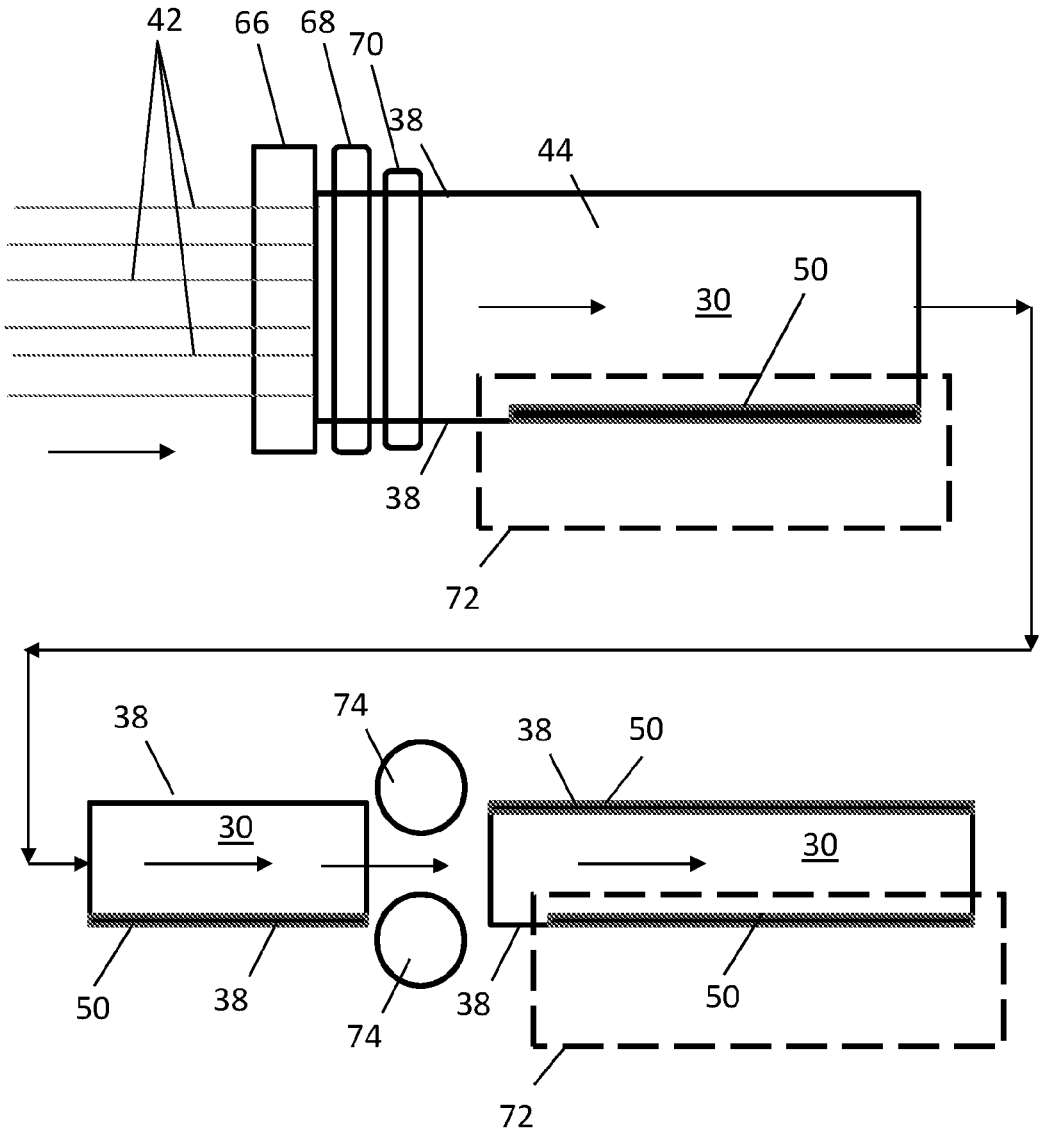
FIG. 7 is an illustration of an embodiment of a manufacturing process for a belt.

In another embodiment, shown in FIG. 7, the electroless plating application of the metallic coating layer 50 may be an integrated part of a continuous belt 30 manufacturing process. In the process of FIG. 7, the tension members 42 are formed and are placed in a selected arrangement. The tension members 42 are then urged through an extruder 66 or other applicator where the jacket material 44 is applied to the tension members 42 forming belt 30. The belt 30 is then cleaned or activated at activator 68. In some embodiments, the belt 30 is masked at masker 70 then a first surface 38 is submerged in the electrolyte solution 72 for application of the metallic coating layer 50 to the first end surface 38. The belt 30 proceeds through rollers 74 or other apparatus to flip the belt 30 such that a second end surface 38 then is submerged in the electrolyte solution 72 for application of the metallic coating layer 50 to the second end surface 38. Applying the metallic coating layer 50 as part of a continuous belt manufacturing process has the additional advantage of streamlining the manufacturing process. Further, the belt 30 has an elevated temperature and is relatively soft after leaving the extruder 66, so applying the metallic coating layer 50 soon after the belt 30 is formed at the extruder 66 may improve adhesion of the metallic coating layer 50 to the jacket material 44.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method for forming a belt for an elevator system comprising:

forming one or more tension elements configured to extend along a belt length;

at least partially enclosing the one or more tension elements in a jacket material, the jacket material defining:

a traction surface;

a back surface opposite the traction surface together with the traction surface defining a belt thickness; and two end surfaces extending between the traction surface and the back surface defining the belt width; and applying a metallic coating layer to at least one end surface of the two end surfaces from a liquid solution to improve fire retardation properties of the belt;

wherein the metallic coating layer is applied discontinuously along the belt length, defining a plurality of coating blocks and a plurality of coating gaps arranged in an alternating pattern along the belt length.

2. The method of claim 1, further comprising applying the metallic coating layer to the at least one end surface and a selected portion of the traction surface and/or the back surface.

3. The method of claim 1, wherein the metallic coating includes one or more of nickel, copper, aluminum, chrome, zinc, tin, gold, silver or alloys thereof, or alloys of nickel and phosphorus, or nickel and polytetrafluoroethylene (PTFE), or nickel and boron or alloys or combinations thereof.

4. The method of claim 1, wherein applying the metallic coating layer further comprises:

activating the at least one end surface to improve adhesion of the metallic coating layer to the at least one end surface;

submerging the at least one end surface in an electrolyte solution for a selected period of time, the electrolyte solution containing a selected metal material; and removing the at least one end surface from the electrolyte solution, the metal material deposited at the at least one end surface to form the metallic coating layer.

5. The method of claim 4, wherein activating the at least one end surface includes one or more of cleaning with an oxidant, depositing a seed metal layer including tin, platinum or palladium, surface cleaning with an organic oxidizer solution or a strong acid solution, plasma treatment, ozone treatment, corona treatment, or UV laser treatment of the jacket material.

6. The method of claim 1, further comprising masking selected portions of the at least one end surface to prevent adhesion of the metallic coating layer at the selected portions resulting in the discontinuous metallic coating layer.

7. The method of claim 1, further comprising applying the metallic coating via an electroless plating process.

8. The method of claim 1, further comprising:

applying the metallic coating layer to a first end surface of the two end surfaces;

turning the belt 180 degrees; and applying the metallic coating layer to a second end surface of the two end surfaces.

9. A belt for an elevator system comprising:

a plurality of tension members arranged along a belt width and extending longitudinally along a belt length;

a jacket material at least partially encapsulating the plurality of tension members defining:

a traction surface;

a back surface opposite the traction surface together with the traction surface defining a belt thickness; and two end surfaces extending between the traction surface and the back surface defining the belt width; and a metallic coating layer applied from a liquid solution disposed over at least one end surface of the two end surfaces;

wherein the metallic coating layer is discontinuous along the belt length, defining a plurality of coating blocks and a plurality of coating gaps arranged in an alternating pattern along the belt length.

10. The belt of claim 9, wherein the metallic coating layer is disposed at the at least one end surface and a selected portion of the traction surface and/or the back surface.

11. The belt of claim 9, wherein the metallic coating layer includes nickel, copper, aluminum, chrome, zinc, tin, gold, silver or alloys thereof, or alloys of nickel and phosphorus, or nickel and polytetrafluoroethylene (PTFE), or nickel and boron or alloys or combinations thereof.

12. The belt of claim 9, wherein the metallic coating layer is configured to improve flame retardation properties of the belt.

13. The belt of claim 9, wherein the jacket material is an elastomeric material.

14. The belt of claim 9, wherein the metallic coating layer is applied via an electroless plating process.

* * * * *